US012799674B2

(12) United States Patent
Zou

(10) Patent No.: US 12,799,674 B2
(45) Date of Patent: Nov. 17, 2026

(54) PRESS COVER WITH REINFORCING THREADS FORMED AS TWISTED YARNS, SHOE PRESS AND METHOD OF PROCESSING A FIBROUS MATERIAL WEB

(71) Applicant: Voith Patent GmbH, Heidenheim (DE)

(72) Inventor: Juanhao Zou, Heidenheim (DE)

(73) Assignee: Voith Patent GmbH, Heidenheim (DE)

( * ) Notice: Subject to any disclaimer, the term of this patent is extended or adjusted under 35 U.S.C. 154(b) by 266 days.

(21) Appl. No.: 18/605,943

(22) Filed: Mar. 15, 2024

(65) Prior Publication Data

US 2024/0218595 A1 Jul. 4, 2024

Related U.S. Application Data

(63) Continuation of application No. PCT/EP2022/075335, filed on Sep. 13, 2022.

(30) Foreign Application Priority Data

Sep. 21, 2021 (DE) ..... 10 2021 124 356.4

(51) Int. Cl.
*D21F 3/02* (2006.01)

(52) U.S. Cl.
CPC ..... *D21F 3/0236* (2013.01)

(58) Field of Classification Search
CPC ..... D21F 3/0236
See application file for complete search history.

(56) References Cited

U.S. PATENT DOCUMENTS

| | | | | |
|---|---|---|---|---|
| 4,787,200 | A | 11/1988 | Inada et al. | |
| 5,134,010 | A | 7/1992 | Schiel | |
| 2005/0009428 | A1* | 1/2005 | Porter | C04B 14/42 442/72 |
| 2011/0017419 | A1* | 1/2011 | Yazaki | D21F 3/0236 427/394 |
| 2018/0051417 | A1* | 2/2018 | Harrington | D21H 17/44 |
| 2019/0040574 | A1* | 2/2019 | Beal | D07B 1/062 |

FOREIGN PATENT DOCUMENTS

| | | | |
|---|---|---|---|
| DE | 3715153 | A1 | 12/1988 |
| DE | 102018116276 | A1 | 12/2019 |
| DE | 102018122780 | A1 | 3/2020 |
| DE | 102019126077 | A1 | 4/2021 |
| EP | 3770309 | A1 | 1/2021 |

* cited by examiner

*Primary Examiner* — Abbas Rashid
*Assistant Examiner* — Stephen M Russell
(74) *Attorney, Agent, or Firm* — Laurence A. Greenberg; Werner H. Stemer; Ralph E. Locher

(57) ABSTRACT

A press cover has at least one polymer layer in which a reinforcing structure is embedded. The reinforcing structure is formed as a scrim with a radially inner layer of longitudinal threads radially outer layer of at least one circumferential thread. The threads are reinforcing threads formed with fibers or fiber bundles twisted in a first direction of rotation and at a first rate of rotation to form a roving. A number of rovings are twisted together in the opposite direction and at a second, higher rate of rotation. In the radial direction of the press cover, the longitudinal threads and the circumferential thread(s) are disposed to touch one another. There is also described a press roll and a shoe press with such a press cover for processing a web of fibrous material.

20 Claims, 3 Drawing Sheets

PRESS COVER WITH REINFORCING THREADS FORMED AS TWISTED YARNS, SHOE PRESS AND METHOD OF PROCESSING A FIBROUS MATERIAL WEB

CROSS-REFERENCE TO RELATED APPLICATION

This application is a continuation, under 35 U.S.C. § 120, of copending International Patent Application PCT/EP2022/075335, filed Sep. 13, 2022, which designated the United States; this application also claims the priority, under 35 U.S.C. § 119, of German Patent Application DE 10 2021 124 356.4, filed Sep. 21, 2021; the prior applications are herewith incorporated by reference in their entirety.

FIELD AND BACKGROUND OF THE INVENTION

The present invention concerns a press cover comprising at least one polymer layer in which a reinforcing structure is embedded, wherein the reinforcing structure is formed as a scrim which comprises a first, radially inner layer made of multiple longitudinal threads extending in the axial direction of the press cover and a second, radially outer layer made of at least one circumferential thread extending substantially in the circumferential direction of the press cover, wherein the longitudinal threads of the first layer and preferably also the at least one circumferential thread of the second layer are each formed as a reinforcing thread which is formed as a twisted yarn, in that firstly several individual fibers or fiber bundles are twisted together in a first twist direction at a first turn rate so as to form a pre-twist, and then several such pre-twists are twisted together in a second twist direction, opposite the first twist direction, at a second turn rate. The invention furthermore concerns a press roll and a shoe press for processing a fibrous material web with such a press cover, and the use of such a press cover in a press, in particular a shoe press, for processing a fibrous material web, in particular a paper, cardboard or tissue web.

Such a press cover has already been described in my earlier German published patent application DE 10 2019 126 077 A1, the content of which is incorporated by reference in full in the present application. The inventor has already found that the use of special twisted yarns as reinforcing threads has an advantageous effect on the press cover, since the risk of premature failure due to an—often only local—overlap in the nip is reduced. In other words, reinforcing threads formed as twisted yarns can help extend the service life of the press cover.

However, there is still a risk that the radially inner longitudinal threads can fail on passage of a knot if, viewed in the radial direction of the press cover, these are arranged such that they touch the at least one radially outer circumferential thread. Simulations by the inventors have shown that the cause is substantial stress concentrations which act locally on the longitudinal threads at the intersection points of the longitudinal threads with the at least one circumferential thread, when the at least one circumferential thread presses directly on the longitudinal threads on passage of a knot. In the press cover from the above-mentioned DE 10 2019 126 077 A1 therefore, the longitudinal threads and the at least one circumferential thread are deliberately arranged such that they do not touch one another. In this way, there is no direct force transmission between these threads, and the matrix material—such as for example polyurethane—arranged in-between can have a damping effect. The disadvantage here however is that the arrangement of the longitudinal threads and the at least one circumferential thread spaced apart from one another is relatively complex during production.

SUMMARY OF THE INVENTION

There is therefore still need for improvement, so the inventor has considered the object of researching further measures for making the press cover even more resistant to overload situations, such as a so-called knot passage, and hence further extend the service life of the press cover. At the same time, the production complexity should be kept as low as possible.

With the above and other objects in view there is provided, in accordance with the invention, a press cover, comprising:

at least one polymer layer;

a reinforcing structure embedded in said at least one polymer layer, said reinforcing structure being a scrim with a first, radially inner layer made of multiple longitudinal threads extending in an axial direction of the press cover and a second, radially outer layer made of at least one circumferential thread extending substantially in a circumferential direction of the press cover;

said longitudinal threads of said first layer, and optionally also the at least one circumferential thread of the second layer, being formed as a reinforcing thread that is formed as a twisted yarn, in that firstly several individual fibers or fiber bundles are twisted together in a first twist direction at a first turn rate so as to form a pre-twist, and then several such pre-twists are twisted together in a second twist direction, opposite the first twist direction, at a second turn rate;

wherein the first turn rate is lower than the second turn rate and, viewed in the radial direction of the press cover, said longitudinal threads and said at least one circumferential thread are arranged to touch one another.

In concrete terms, after intensive analysis of causes and a number of experiments, the inventor has surprisingly found that this object can be achieved if, with the generic press casing described initially, the first turn rate is selected lower than the second turn rate. Also, the production complexity can be kept low if, viewed in the radial direction of the press cover, the longitudinal threads and the at least one circumferential thread are arranged relative to one another such that they touch.

Such a choice of turn rates in twisted yarns is extremely unusual. As known to the person skilled in the art of textile technology, in particular yarns, the characteristic behavioral properties of a twisted yarn depend less on its turn rate, i.e., the number of twists per meter length of yarn, and much more on the twist angle of the individual strands from which the twisted yarn is created by twisting. This twist angle in turn depends decisively on the diameter of the yarn. The correlation between the yarn diameter and the twist angle is illustrated schematically in FIG. 1, wherein d is the diameter of the twisted yarn, I the length of the twist for a complete turn of one of the strands, and θ is the twist angle. The following formula applies:

$$\tan\theta = \frac{\pi d}{l}$$

It is evident from this that the twist angle is larger, the greater the yarn diameter. Furthermore, as already mentioned, it is known that the characteristic behavioral properties of the yarn depend on the twist angle. Thus for example the swirl increases when the twist angle increases.

Usually, the aim is to keep the swirl of a yarn low, since otherwise this leads to the yarn ruffling. Therefore, in two-stage twisted yarns, i.e. yarns produced from pre-twists, the twist directions are always opposite one another. Thus for example the pre-twist may be twisted in the S direction and the final yarn produced from multiple pre-twists twisted in the Z direction, as illustrated for example in FIG. 2. Since the pre-twists naturally have a much smaller diameter than the final yarn produced therefrom, their turn rates must be significantly higher than the turn rate of the final yarn. Only in this way can a similar or identical twist angle be achieved for the pre-twist, and hence similar or identical characteristic behavioral properties. In particular, the swirl given to the final yarn in the second twist stage by twisting the pre-twists can thus be compensated. As a result, the final yarn can be laid straight without pretension on a flat substrate without having a tendency to ruffle. Therefore with two-stage twisted yarns, the first turn rate is almost always selected higher than the second turn rate.

Indeed, in the sector of vehicle tire manufacture, it is already known to use as reinforcing threads twisted yarns which consist of a pre-twist having a first turn rate which is lower than the second turn rate of the final yarn formed from several pre-twists. Reference is made here for example to U.S. Pat. No. 4,787,200 by Bridgestone. Since however the design of the reinforcing structure in a car tire differs fundamentally from the above-described design of the reinforcing structure in a press cover, the same problems do not arise here, in particular local over-stressing at the intersection points of the longitudinal and circumferential threads. In car tires, there are usually no longitudinal threads which radially outwardly touch at least one circumferential thread. The actual problems to be solved here are of a different nature, although the solutions finally lead to a longer service life of the car tire. Accordingly, the person skilled in the art of press covers would have no reason to consult this prior art from a totally different specialist area.

The same applies accordingly to the technical field of toothed belt production, as described for example in European published patent application EP 3 770 309 A1 by Nippon.

For a person skilled in the art of production of press covers, there is no evident reason for selecting or specially manufacturing reinforcing threads formed as twisted yarns which deviate from the conventional basic principle.

It is therefore to the credit of the inventor to have found that in press covers, with respect to their resistance to overload, it is advantageous to select the first turn rate lower than the second turn rate in a reinforcing thread formed as a twisted yarn. The tendency of the reinforcing thread to ruffle may be countered by a corresponding pretension with which this is embedded in the polymer matrix.

FIG. 3 shows schematically the test structure for determining the radial hardness of a reinforcing thread formed as a twisted yarn. The greater the deformation $\Delta L$ in the radial direction of the reinforcing thread for a predefined force loading (here 9.8N), the softer the reinforcing thread in its radial direction.

The inventor has found that a twisted yarn with a first turn rate which is lower than the second turn rate behaves substantially more softly in the radial direction under a low pretension than the same twisted yarn under a high pretension. This hardness difference is substantially greater than with conventional twisted yarns, in which the first turn rate is higher than the second turn rate. In a press cover, this behavior can be positively exploited. There, namely, typically the reinforcing threads arranged radially further in, in particular longitudinal threads extending in the axial direction of the press cover and forming a first scrim, are given a greater pretension than the at least one reinforcing thread arranged radially further out, in particular at least one circumferential thread extending substantially in the circumferential direction. Thus on use of one and the same twisted thread material, it can be ensured that the at least one reinforcing thread arranged radially further out is softer in the radial direction than the reinforcing threads arranged radially further in.

This is advantageous since the at least one reinforcing thread arranged further radially out and formed relatively soft reduces the risk of cracks forming, starting from the outer surface of the press cover, when the press cover is exposed to an overload situation. As the inventor was able to observe, such cracks often begin at the base of grooves which are typically provided on the outer surface of such a press cover. The stress peaks in the polymer material, in particular at the groove base, of the press cover may however be reduced if the at least one radially outer reinforcing thread is formed relatively soft.

At the same time, it was found that it is advantageous if the radially inner reinforcing threads are formed as hard as possible. These threads almost always tend to break first on passage of a knot, wherein this danger is countered if they are made correspondingly hard.

In tests, it has proved advantageous if the first turn rate corresponds to 70% to 90% of the second turn rate, wherein the first turn rate is preferably between 70 and 90, further preferably between 75 and 85, and even further preferably 80 turns per meter.

As usual for example with sewing threads, the first twist direction may be the S direction, and the second twist direction the Z direction. Such a typical sewing thread is shown for example in FIG. 2.

In contrast to the typical sewing thread shown in FIG. 2, for the reinforcing thread according to the present invention, it is preferred if each pre-twist is formed from two individual fibers or fiber bundles, and the final twisted yarn is formed from three pre-twists. In this way, a particularly stable reinforcing thread can be achieved. The reinforcing thread in particular should also be able to withstand tensile forces along its longitudinal extent direction.

As already mentioned above, for production reasons it is highly advantageous if, according to the present invention, the reinforcing structure is formed as a scrim which has a first layer of multiple longitudinal threads extending in the axial direction of the press cover, and a second layer of at least one circumferential thread extending substantially in the circumferential direction of the press cover, wherein the longitudinal threads and the at least one circumferential thread, viewed in the radial direction of the press cover, are arranged relative to one another such that they touch. The phrase "substantially in the circumferential direction" may in particular be understood to mean that the at least one circumferential thread extends as a helix around the longitudinal axis of the press cover. Also more than one circumferential thread may be contained in the second layer and these arranged relative to one another as in a screw with multiple thread turns. Preferably, the longitudinal threads of the first layer and/or the at least one circumferential thread of the second layer correspond to the at least one reinforcing thread formed as a twisted yarn.

In a refinement of the concept, it is proposed that the longitudinal threads of the first layer in the press cover have a first pretension, whereas the at least one circumferential thread of the second layer has a second pretension, wherein the first pretension is greater than the second pretension, and wherein preferably the first pretension corresponds to at least 7 times and/or at most 13 times the second pretension. This leads to the advantageous different hardnesses, already described above, of the reinforcing threads in the two layers, even if the same thread material is used there.

It is sufficient if the entire reinforcing structure of the press cover consists only of the first layer and the second layer.

It has furthermore proved advantageous if the at least one reinforcing thread formed as a twisted yarn has a coating. The coating may support the binding of the yarn to the surrounding polymer matrix.

It is favorable if the at least one reinforcing thread formed as a twisted yarn has a fineness between 800 dtex and 1500 dtex, preferably between 1000 dtex and 1200 dtex, further preferably 1100 dtex. The unit dtex is an abbreviation of decitex, or 10 tex, wherein the official tex system is a weight numbering, i.e. indicates the fineness of a yarn. The fineness is defined by the weight of a specific length of yarn. The unit tex indicates the weight of one kilometer of yarn in grams (e.g. 1 dtex=10 tex: 1 km of yarn weighs 10 grams). If the reinforcing thread is too fine, it cannot resist the tensile forces to the scope necessary in the press cover. If however the reinforcing thread is too coarse, this leads to problems in the binding to the polymer matrix.

It has proved advantageous if the pre-twists are each formed from several fiber bundles, wherein each fiber bundle has between 180 and 230 individual filaments.

Preferably, all threads of the reinforcing structure of the press cover correspond to the at least one reinforcing thread formed as a twisted yarn. This applies in particular to the first and second turn rates.

It is quite particularly preferred if all threads of the reinforcing structure of the press cover are formed identically to one another. Thus large quantities of the same fiber material may be purchased and processed, which keeps down the costs of production of the press cover.

A further aspect of the present invention concerns a press roll for a shoe press for processing a fibrous material web, wherein the press roll has at least one press cover according to the invention as described above.

Yet a further aspect of the present invention concerns a shoe press for processing a fibrous material web, in particular a paper, cardboard or tissue web, comprising a press roll and a counter-roll which together form or delimit an extended pressing gap, wherein the press roll comprises a circumferential press cover configured according to the present invention.

The present invention also concerns the use of a press cover configured according to the invention and as described above, in particular a shoe press, for processing a fibrous material web, in particular a paper, cardboard or tissue web.

Other features which are considered as characteristic for the invention are set forth in the appended claims.

Although the invention is illustrated and described herein as embodied in a press cover with reinforcing threads formed as twisted yarns, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 5:
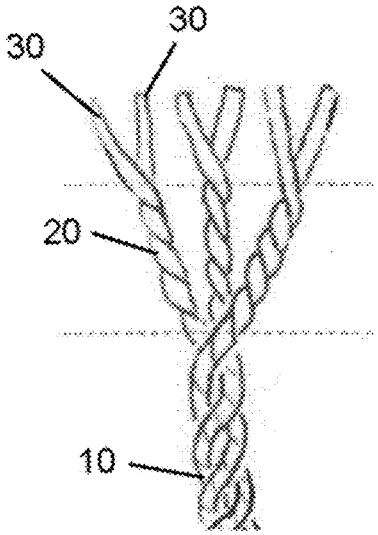
FIG. 5 shows a reinforcing thread for a press cover according to the present invention.
Figure 6:
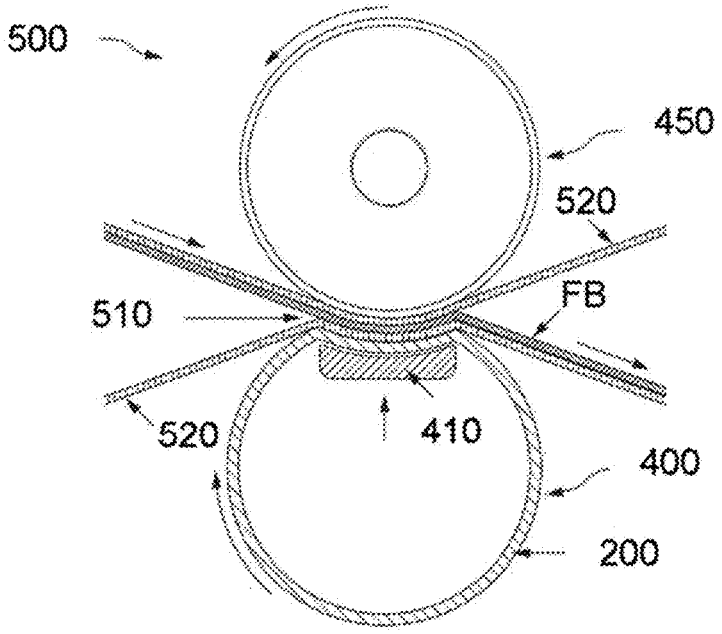
FIG. 6 shows a shoe press with a press cover according to the invention.

FIG. 5 shows an exemplary reinforcing thread 10 which is configured according to the present invention in order to be installed as part of the reinforcing structure 100 in a press cover 200 according to the invention (see FIG. 6). The reinforcing thread 10 is formed as a twisted yarn, wherein firstly two fiber bundles 30 are twisted in the S twist direction at a first turn rate into a pre-twist 20, and then three such identically produced pre-twists 20 are twisted in the Z direction at a second turn rate to form the final yarn or reinforcing thread 10. The reinforcing thread 10 may then also be coated.

According to the present invention, the first turn rate is lower than the second turn rate. The first turn rate in this exemplary embodiment is 80 and the second turn rate 100 turns per meter. The thread has a fineness of 1100 dtex. Thus the reinforcing thread 10 according to the present invention can be characterized in brief as follows:

$$dtex\ 1100 \times 2 \times 3\ S80/Z100.$$

Figure 1:
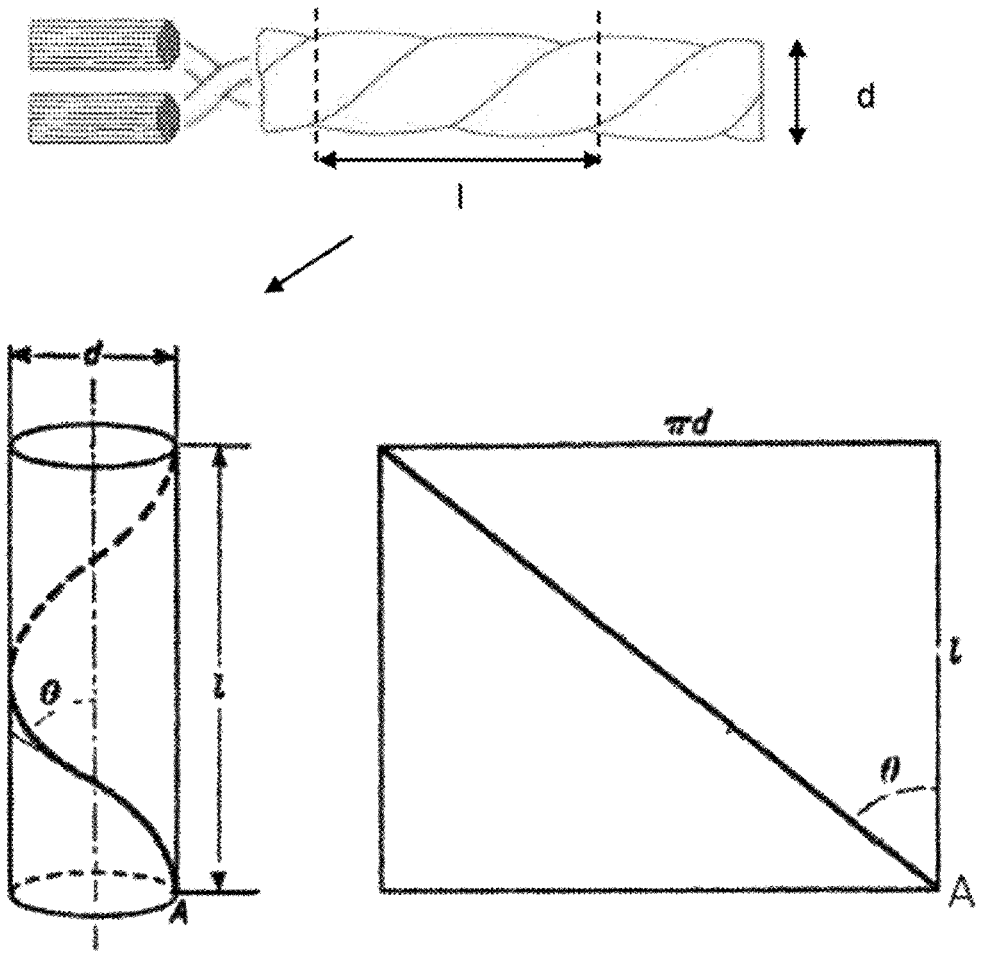
FIG. 1 shows a sketch to illustrate the general correlation between yarn diameter and twist angle.
Figure 2:
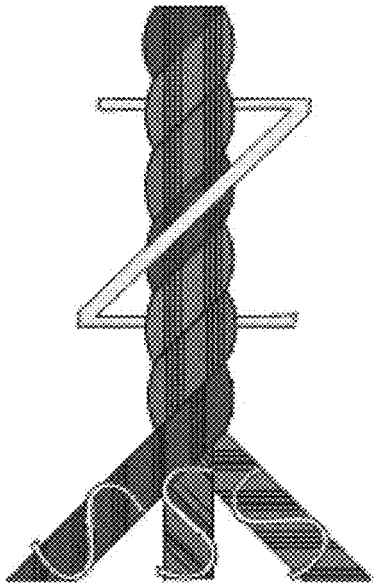
FIG. 2 shows an example of a typical twisted yarn such as a sewing thread, in which three pre-twists twisted in the S direction are twisted together in the Z direction.
Figure 3:
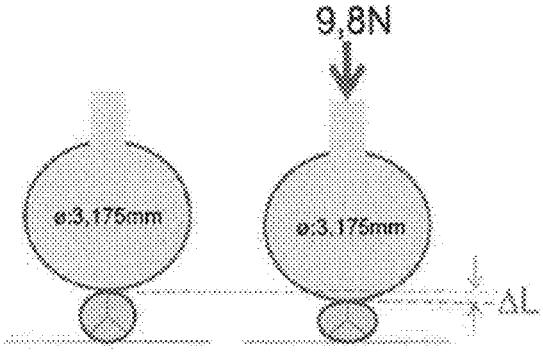
FIG. 3 shows a sketch to illustrate how the radial hardness of the reinforcing thread is determined.

This exemplary embodiment of a reinforcing thread 10 for a press cover according to the invention, which exemplary embodiment is designated below as AB-1, was now tested with respect to its radial hardness in the test structure described above with reference to FIG. 3, and compared with two exemplary embodiments AB-2 and AB-3 of a respective reinforcing thread from the prior art. The reinforcing threads according to AB-2 and AB-3 indeed have the same basic structure (as shown in FIG. 5) as the exemplary embodiment AB-1, but in these reinforcing threads the first turn rate is higher than the second turn rate. In brief, the reinforcing thread according to AB-2 may be characterized as follows:

$$dtex\ 1100 \times 2 \times 3\ S165/Z150$$

and the reinforcing thread according to AB-3 as follows:

*dtex* 1100×2×3 *S*100/*Z*80.

In AB-2, the first turn rate is therefore 165 turns per meter, and the second turn rate 150 turns per meter, whereas in AB-3 the first turn rate is 100 turns per meter and the second turn rate 80 turns per meter.

Figure 4:
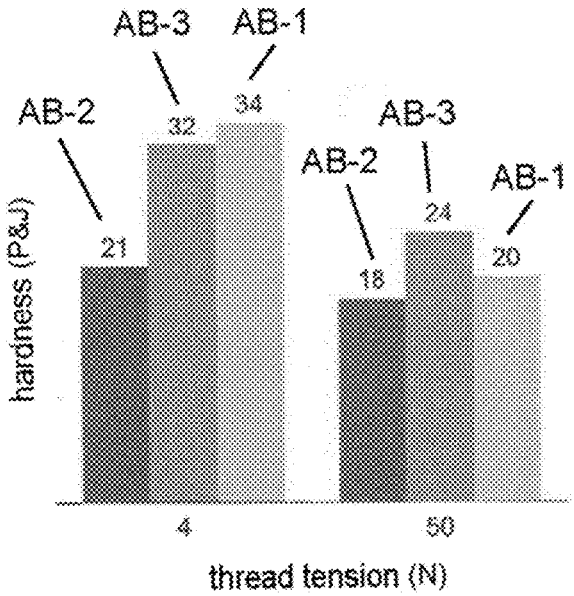
FIG. 4 shows a comparison of the radial hardnesses of different reinforcing threads at different pretensions.

FIG. 4 shows the result of this comparison, wherein the X-axis shows the pretension in Newtons (N) to which the reinforcing threads were exposed during the test. The Y axis shows the hardness in Pussey & Jones (P&J). It should be noted that a lower P&J value indicates a greater hardness than a higher P&J value.

It is evident from FIG. 4 that under a low pretension of 4N, the P&J hardness of the exemplary embodiment AB-1 according to the present invention is 34, which is significantly higher than for AB-2 (only 21) and slightly higher than for AB-3 (32). In other words, under a low pretension, the reinforcing thread 10 according to the invention is relatively soft in the radial direction in comparison with reinforcing threads of the prior art. At a significantly higher pretension of 50N, the P&J hardness of the exemplary embodiment AB-1 according to the present invention is however only 20. It is therefore lower than the P&J hardness of AB-3 (24) and only slightly higher the P&J hardness of AB-2 (18). In other words, under a higher pretension, the reinforcing thread 10 according to the invention is harder, or at least as hard, in the radial direction as the reinforcing threads from the prior art.

This great deviation in radial hardness of the reinforcing thread 10 according to the invention is advantageously utilized by the press cover 200 of the present invention. Several of these reinforcing threads 10, which extend as longitudinal threads 220 parallel to the axis 1 of the press cover 200, form a first layer of a reinforcing structure 100. Furthermore, at least one of these reinforcing threads 10, which is wound as a circumferential thread 230 in a helix about the axis A (see FIG. 7) radially on the outside of the first layer, forms a second layer of the reinforcing structure 100. Preferably, the entire reinforcing structure 100 of the press cover 200 according to the invention consists only of these two layers.

Figure 7:
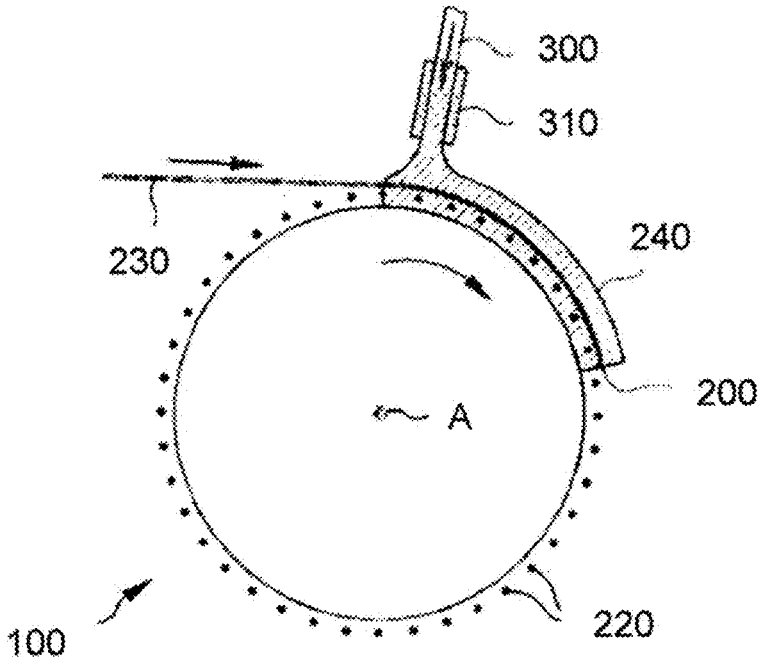
FIG. 7 shows a sketch to illustrate a production process for the press cover according to the invention.

The press cover 200 may be produced as illustrated schematically in FIG. 7. In a highly schematic side view, FIG. 7 shows a device for production of the press cover 200 according to the invention. The device in this case has precisely one cylindrical winding mandrel. On the periphery are a plurality of reinforcing threads 10 formed as longitudinal threads 220 spaced apart from one another. A polymer is applied on the radially outermost casing surface of the winding mandrel in order to create a polymer coating 240. In addition, for example, a circumferential thread 230 is introduced in a helical pattern into the polymer of the polymer layer 240. After embedding in the polymer, the circumferential thread 230 together with the longitudinal threads 220 forms the reinforcing structure 100 of the final press cover 200 according to the invention. According to the invention, the circumferential thread 230 touches the longitudinal threads 220, i.e. viewed in the radial direction of the press cover 200, there is no spacing between them.

The winding mandrel is mounted rotatably about its longitudinal axis, which corresponds to the longitudinal axis A of the later press cover 200. The longitudinal axis here runs orthogonally into the drawing plane. Via a line 300, the casting material, in the form of a castable, hardenable elastomer polymer, e.g. polyurethane, is applied from above through a casting nozzle 310 onto the radially outermost casing surface of the winding mandrel or onto the longitudinal threads 220. Such a casting material may be selected, e.g. with respect to its pot life and viscosity, such that it does not drip from the winding mandrel during casting. During this process, the winding mandrel is rotated about its longitudinal axis in the direction of the arrow. At the same time as this rotation, the casting nozzle 310 is guided parallel to and along the longitudinal axis A relative to the winding mandrel via a suitable guide (not shown in detail in FIG. 7). Simultaneously with the casting of the casting material, the at least one circumferential thread 230 is unrolled and wound in a helix pattern to form turns about the rotating winding mandrel. The casting material can penetrate onto the winding mandrel through the longitudinal threads 220. In this example, after the step of hardening, the polymer forms a radially innermost and preferably elastomer polymer layer such as e.g. the polymer layer 240. In addition, if necessary further polymer layers may be applied radially on the outside. Preferably however, the entire reinforcing structure 100 is completely embedded in the radially innermost polymer layer 240.

The casting material emerging from the casting nozzle 6 is a mixture of the pre-polymer and a cross-linking agent. The former is provided from a prepolymer container (not shown) in which it is stored or agitated. The prepolymer may comprise an isocyanate according to the invention and a polyol. It may be present in the prepolymer container for example in the form of a prepolymer of the above-mentioned substances. The cross-linking agent may be provided in a cross-linking agent container. The prepolymer container and cross-linking agent container are assigned to the device for production of the press cover 200. They are connected fluid-conductively via lines (not shown) to a mixing chamber (also not shown) arranged upstream of the casting nozzle 310 in the flow direction. The mixture of prepolymer and cross-linking agent is thus produced upstream and outside the casting nozzle 310, i.e. mixed in the mixing chamber. Irrespective of production of the mixture, this is then applied to the surface of the winding mandrel in order to form the at least one polymer layer of the press cover 200.

By means of such a continuous casting process, which is also known as rotational casting, gradually over the width of the winding mandrel, an endless cylindrical press cover 200 is produced which is closed in itself about its longitudinal axis a and the inner circumference of which corresponds substantially to the outer circumference of the winding mandrel 4.

Preferably, the longitudinal threads 220 are pretensioned with a greater pretension, for example a pretension of 50N, than the at least one circumferential thread 230 which may be pretensioned with a pretension of just 4N, when the reinforcing structure 100 is embedded in the polymer layer 240. As a result, the reinforcing threads 10 according to the invention, which as longitudinal threads 220 form the first layer of the reinforcing structure 100, are substantially harder than the at least one reinforcing thread 10 according to the invention, which as a circumferential thread 230 forms the second layer of the reinforcing structure 100. This has an advantageous effect on the resistance of the press cover 200 according to the invention on passage of a knot.

FIG. 6 shows a partially sectioned, schematic side view of a shoe press 500 which in the present case comprises a press roll 400 according to the invention, namely a shoe press roll, and a counter-roll 450. The longitudinal axes of the shoe press roll 400 and the counter-roll 450 are arranged parallel to one another. Together these rolls form or delimit an extended pressing gap 510.

Whereas the counter-roll 450 here consists of a cylindrical roll configured to rotate about its longitudinal axis, the shoe press roll 400 is composed of a shoe 410, an upright yoke carrying this, and the press cover 200 according to the invention. The shoe 410 and the yoke are arranged stationarily with respect to the counter-roll 450 or the press cover 200. This means that they do not rotate. The shoe 410 is supported by the yoke and not pressed via the hydraulic press elements (not shown) against the radially innermost surface of the press cover 200 which rotates relative thereto. The press cover 200, which surrounds the shoe 410 and the yoke in the circumferential direction, rotates about its longitudinal axis A in the opposite rotational direction to the counter-roll 450. Because of the concave design of the shoe 410 on its side facing the counter-roll 450, the pressing gap 510 is comparatively long.

The shoe press 500 is particularly suitable for dewatering fibrous material webs FB. During operation of the shoe press 500, a fibrous material web FB with one or two press felts 520 is guided through the pressing gap 510. In the present case there are precisely two press felts 520 which receive the fibrous material web FB between them in sandwich fashion. On passage through the extended pressing gap 510, the press felt 520 exerts an indirect pressure on the fibrous material web FB in the extended pressing gap 510. This is because the radially outermost surface of the counter-roll 450 on one side, and the radially outermost surface of the press cover 200 on the other, come into direct contact with the corresponding press felt 520. The liquid emerging from the fibrous material web FB is temporarily received by the press felt(s) 520 and any depressions, in particular grooves (not shown), provided in the surface of the press cover. After leaving the extended pressing gap 510, the liquid received by the depressions of the press cover 200 is expelled before the press cover 200 again enters the pressing gap 510. Also the water received by the press felt 520 may be removed with suction elements after leaving the pressing gap 510.

In a further embodiment of the invention (not shown in the figures), the press felt 520 may be omitted. In such a case, the fibrous material web FB is in direct contact on one side with the press cover 200 and on the other with the counter-roll 450, which together form a pressing gap 510. The latter roll may then be configured as a heated dry cylinder.

The following is a summary list of reference numerals and the corresponding structure used in the above description of the invention:

10 Reinforcing thread
20 Pre-twist
30 Fiber bundle
100 Reinforcing structure
200 Press cover
220 Longitudinal thread
230 Circumferential thread
240 Polymer layer
300 Line
310 Casting nozzle
400 (Shoe) press roll
410 Shoe
450 Counter roll
500 Shoe press
510 (Extended) pressing gap
520 Press felt
A Axis (of press cover)
AB-1 Exemplary embodiment 1 (according to the present invention)
AB-2 Exemplary embodiment 2 (according to the prior art)
AB-3 Exemplary embodiment 3 (according to the prior art)
FB Fibrous material web

The invention claimed is:

1. A press cover, comprising:

at least one polymer layer forming a substantially cylindrical tube defining a circumferential direction, an axial direction, and a radial direction of the press cover;

a reinforcing structure embedded in said at least one polymer layer, said reinforcing structure being a scrim with a first, radially inner layer made of multiple longitudinal threads extending in the axial direction of the press cover and a second, radially outer layer made of at least one circumferential thread extending substantially in the circumferential direction of the press cover;

said longitudinal threads of the first layer, and optionally also the at least one circumferential thread of the second layer, being formed as a reinforcing thread that is formed as a twisted yarn, in that firstly several individual fibers or fiber bundles are twisted together in a first twist direction at a first turn rate so as to form a pre-twist, and then several such pre-twists are twisted together in a second twist direction, opposite the first twist direction, at a second turn rate;

wherein the first turn rate is lower than the second turn rate and, viewed in the radial direction of the press cover, said longitudinal threads and said at least one circumferential thread are arranged to touch one another.

2. The press cover according to claim 1, wherein the first turn rate amounts to 70% to 90% of the second turn rate, and the first turn rate is between 70 and 90 turns per meter.

3. The press cover according to claim 2, wherein the first turn rate is between 75 and 85 turns per meter.

4. The press cover according to claim 2, wherein the first turn rate is 80 turns per meter.

5. The press cover according to claim 1, wherein the first twist direction is an S direction and the second twist direction is a Z direction.

6. The press cover according to claim 1, wherein each pre-twist is formed from two individual fibers or fiber bundles, and the final twisted yarn is formed from three pre-twists.

7. The press cover according to claim 1, wherein the longitudinal threads of the first layer in the press cover have a first pretension, whereas the at least one circumferential thread of the second layer has a second pretension, and the first pretension is greater than the second pretension.

8. The press cover according to claim 7, wherein the first pretension amounts to at least 7 times and/or at most 13 times the second pretension.

9. The press cover according to claim 1, wherein an entire said reinforcing structure of the press cover consists only of the first layer and the second layer.

10. The press cover according to claim 1, wherein the twisted yarn of said at least one reinforcing thread includes a coating.

11. The press cover according to claim 1, wherein the at least one reinforcing thread formed as a twisted yarn has a fineness between 800 dtex and 1500 dtex.

12. The press cover according to claim 11, wherein the at least one reinforcing thread has a fineness between 1000 dtex and 1200 dtex.

13. The press cover according to claim 11, wherein the at least one reinforcing thread has a fineness of 1100 dtex.

14. The press cover according to claim 1, wherein each of said pre-twists are formed from several fiber bundles, with each fiber bundle having between 180 and 230 individual filaments.

15. The press cover according to claim 1, wherein all threads of said reinforcing structure of the press cover correspond to said at least one reinforcing thread formed as a twisted yarn.

16. The press cover according to claim 1, wherein all threads of said reinforcing structure of the press cover are formed identically to one another.

17. A press roll for a shoe press for processing a fibrous material web, the press roll comprising at least one press cover according to claim 1.

18. A shoe press for processing a fibrous material web, the shoe press comprising: a press roll and a counter-roll which together form or delimit an extended pressing nip, wherein said press roll comprises a circumferential press cover configured as a press cover according to claim 1.

19. The shoe press according to claim 18 configured for processing a paper web, a cardboard web, or a tissue web.

20. A method of processing a fibrous material web which comprises providing a shoe press with a press cover according to claim 1, and processing a fibrous material web, being a paper web, a cardboard web, or a tissue web in the shoe press.

* * * * *